US006240987B1

(12) United States Patent
Birkeland

(10) Patent No.: US 6,240,987 B1
(45) Date of Patent: Jun. 5, 2001

(54) TOOL SUPPORTING DEVICE

(76) Inventor: Clinton D. Birkeland, P.O. Box 336, 336 UC Rd., Dupree, SD (US) 57623-0336

( * ) Notice: Subject to any disclaimer, the term of this patent is extended or adjusted under 35 U.S.C. 154(b) by 0 days.

(21) Appl. No.: 09/533,190

(22) Filed: Mar. 23, 2000

(51) Int. Cl.[7] ..... B25H 1/00

(52) U.S. Cl. ..... 144/286.1; 108/69; 144/286.5; 144/287

(58) Field of Search ..... 108/64, 65, 69, 108/77, 80, 79, 118, 121, 129, 132; 144/286.1, 286.5, 287, 1.1, 135.2; 269/901; 280/30

(56) References Cited

U.S. PATENT DOCUMENTS

| | | | | |
|---|---|---|---|---|
| 1,862,911 | * | 6/1932 | Snyder | 108/69 |
| 2,684,275 | * | 7/1954 | Guth et al. | 144/287 |
| 2,978,754 | * | 4/1961 | Wilson | 108/70 |
| 4,155,386 | * | 5/1979 | Alessio | 144/286.1 |
| 4,328,846 | * | 5/1982 | Hanson | 144/287 |
| 4,974,651 | | 12/1990 | Carmon et al. | 144/286.1 |
| 5,067,535 | * | 11/1991 | Wolff | 144/286.1 |
| 5,518,053 | | 5/1996 | Robison | 144/286.1 |
| 5,657,703 | * | 8/1997 | Johnson | 108/69 |
| 5,778,953 | * | 7/1998 | Braddock | 144/286.1 |
| 5,823,595 | * | 10/1998 | Tronco | 108/69 |
| 5,863,052 | * | 1/1999 | Roman | 280/30 |

* cited by examiner

*Primary Examiner*—W. Donald Bray
(74) *Attorney, Agent, or Firm*—Jacobson & Johnson

(57) ABSTRACT

A tool supporting device is provided having a main table surface which is supported on a collapsible frame of legs. The legs and the main table surface pivot into a substantially flat collapsed position. A pair of auxiliary table surfaces are pivotally mounted on respective ends of the main table surface. Each auxiliary table surface includes an auxiliary leg supporting a free end thereof. The auxiliary legs are pivotally mounted to be positioned alongside the respective auxiliary tables to lie flat in the collapsed position. The tool supporting device is thus arranged to support tools and work materials thereon at various relative heights and angles therebetween.

20 Claims, 6 Drawing Sheets

(A)

(B)

TOOL SUPPORTING DEVICE

FIELD OF THE INVENTION

This invention relates to a tool supporting device and more particularly to a portable device arranged to support tools thereon.

BACKGROUND

When working with power tools, for example power saws and routers, it is often desirable to support the tools and related work materials on a bench or table in a workshop. These tables however are generally not portable and of no use when away from the workshop. The use of a portable workbench or table is occasionally used for assisting in supporting materials when working on a job site away from a workshop, however, these portable devices are often large and awkward in size and do not provide a suitable supporting surface for supporting both tools and work materials thereon.

U.S. Pat. No. 5,518,053 to Robison and U.S. Pat. No. 4,974,651 to Carmon et al each provide a portable tool and work supporting device. Each device includes a housing supported on collapsible legs and having multiple attachments mounted thereon. Both devices however are significant in size and complexity such that the devices are awkward to manipulate between a collapsed position and a supporting position for supporting the materials thereon.

The present invention is concerned with certain improvements to portable tool supporting devices.

SUMMARY

According to the present invention there is provided a tool supporting device comprising:

a first pair of elongate legs mounted parallel and spaced apart from each other, each leg having a ground engaging end and a supporting end;

a second pair of elongate legs mounted parallel and spaced apart from each other, each leg having a ground engaging end and a supporting end, the second pair of legs being pivotally coupled to the first pair of legs between respective ends of both pairs wherein the second pair of legs is laterally offset from the first pair of legs such that the legs are pivotal between a collapsed position wherein the legs are substantially parallel and adjacent to each other and a supporting position wherein the supporting and ground engaging ends of the respective first and second pairs of legs are spaced apart from each other; and a main supporting surface extending longitudinally between respective first and seconds ends thereof, the supporting surface being pivotally mounted at the first end on the first pair of legs adjacent the supporting end thereof and being selectively coupled at the second end on the second pair of legs adjacent the supporting end thereof in the supporting position, the supporting surface being located between the legs of each of the first and second pairs of legs such that when the second end of the supporting surface is released from the second pair of legs, the supporting surface is pivotal into the collapsed position wherein the legs extend longitudinally along respective sides of the supporting surface within a substantially common plane therewith.

The use of a supporting surface having legs mounted along respective sides thereof forms a substantially flat structure which is simple in construction and occupies minimal space in a collapsed position. The flat design further permits a pair of auxiliary supporting surfaces to be coupled thereto and positioned adjacent the respective top and bottom faces of main supporting surface in the collapsed position.

The first pair of elongate legs are preferably spaced inwardly from the second pair of elongate legs such that the supporting surface is received therebetween in the collapsed position.

A pair of wheels is preferably mounted adjacent the supporting end of one of the pairs of legs for engaging the ground in the collapsed position.

There may be provided a wheel mount mounting the wheels thereon wherein the wheel mount is mounted on one of the pairs of legs and extends outwardly therefrom at a position spaced inwardly from the supporting end of the legs such that the wheels do not extend past the supporting surface in the supporting position.

There may be provided an adjustable mount on the supporting surface such that the supporting surface is adjustable in length whereby adjustment of a length of the supporting surface will correspondingly adjust a height of the legs supporting the supporting surface thereon.

The supporting surface preferably comprises a first portion telescopically received within a second portion thereof and the adjustable mount comprises a locking member which is received through co-operating apertures in the first and second portions such that the locking member restricts relative movement therebetween.

A pivot shaft is preferably mounted on the supporting end of the first pair of legs to extend therebetween and wherein the first end of the supporting surface comprises a tubular member arranged to receive the pivot shaft therethrough such that the supporting surface is rotatable about the pivot shaft.

There may be provided a cross member mounted between the legs of the second pair of legs adjacent the supporting end thereof and wherein there is provided at least one hook member mounted on the second end of the supporting surface arranged to receive the cross member therein in the supporting position for selectively coupling the supporting surface to the second pair of legs.

The supporting surface may be supported at respective ends on the first and second pairs of legs respectively by a collar slidably mounted on each leg and wherein there is provided a locking member for securing each collar in place such that a height of the frame is adjustable.

There may be provided a cross member mounted between the legs of one of the pairs, the cross member being mounted perpendicularly to the legs for supporting a reel thereon such that the reel is rotatably mounted thereon between the legs.

A curved portion is preferably located at a ground engaging end of each leg for sliding movement along the ground as the legs are displaced between the collapsed and supporting positions.

According to a further aspect of the present invention there is provided a tool supporting device comprising:

a first pair of elongate legs mounted parallel and spaced apart from each other, each leg having a ground engaging end and a supporting end;

a second pair of elongate legs mounted parallel and spaced apart from each other, each leg having a ground engaging end and a supporting end, the second pair of legs being pivotally coupled to the first pair of legs between respective ends of both pairs wherein the second pair of legs is laterally offset from the first pair of legs such that the legs are pivotal between a collapsed position wherein the legs are substantially parallel and adjacent to each other and a supporting position wherein the supporting and ground engaging ends of the respective first and second pairs of legs are spaced apart from each other;

a main supporting surface extending longitudinally between respective first and seconds ends thereof, the supporting surface being pivotally mounted at the first end on the first pair of legs adjacent the supporting end thereof and being selectively coupled at the second end on the second pair of legs adjacent the supporting end thereof in the supporting position, the supporting surface being located between the legs of each of the first and second pairs of legs such that when the second end of the supporting surface is released from the second pair of legs, the supporting surface is pivotal into the collapsed position wherein the legs extend longitudinally along respective sides of the supporting surface within a substantially common plane therewith;

an auxiliary supporting surface pivotally mounted at an inner end thereof adjacent the supporting end of one of the pairs of legs and extending outwardly to a free end thereof, the inner end of the auxiliary supporting surface being offset from the supporting end of the pairs of legs such that the auxiliary support surface is pivotal to extend parallel and adjacent to the main supporting surface in the collapsed position; and an auxiliary leg pivotally mounted on the free end of the auxiliary supporting surface being arranged to support the auxiliary supporting surface to extend substantially parallel to the main supporting surface in the supporting position, the auxiliary leg being coupled to a side of the auxiliary supporting surface such that in the collapsed position the leg is pivotal to extend longitudinally alongside the auxiliary supporting structure within a substantially common plane therewith.

The auxiliary leg is preferably adjustable in length such that the auxiliary supporting surface can be supported at various angles relative to the main supporting surface in the supported position.

There may be provided a pivot shaft mounted between legs of one of the pairs adjacent the supporting end thereof, wherein an end of the auxiliary supporting surface comprises a tubular member mounting the pivot shaft therethrough such that the auxiliary supporting surface is rotatable about the pivot shaft.

There may further be provided a pivot shaft mounted on an end of the auxiliary leg, wherein an end of the auxiliary supporting surface comprises a tubular member mounting the pivot shaft therethrough such that the auxiliary leg is rotatable relative to the auxiliary supporting surface.

The auxiliary leg preferably has a foot mounted on an end thereof, the foot comprises a rigid member which extends at right angles to the leg.

There is preferably provided a pair of wheels mounted on the supporting end of one of the pairs of legs and wherein there is provided a coupling on a free end of the auxiliary leg being arranged to secure the auxiliary supporting surface to extend transversely to the main supporting surface in a transport position, the supporting surfaces defining cradle therebetween supported for rolling movement on the ground in the transport position.

There is preferably provided a pair of auxiliary supporting surfaces mounted on the first and second pairs of legs respectively, each auxiliary supporting surface having an auxiliary leg mounted on a free end thereof.

The main supporting surface may be coupled to the respective first and second pairs of legs at a location spaced inwardly from the supporting ends thereof such that the main supporting surface is spaced below the auxiliary supporting surface in the supporting position.

The auxiliary supporting surface may comprise a pair of side rails mounted parallel and spaced apart by a pair of parallel and spaced apart cross members defining a rectangular opening therebetween and wherein there is provided a plurality of flange members mounted in the opening of the auxiliary supporting surface defining a shoulder of the opening for supporting a rectangular plate member therein.

BRIEF DESCRIPTION OF THE DRAWINGS

In the accompanying drawings, which illustrate an exemplary embodiment of the present invention.

DETAILED DESCRIPTION

Figure 1:
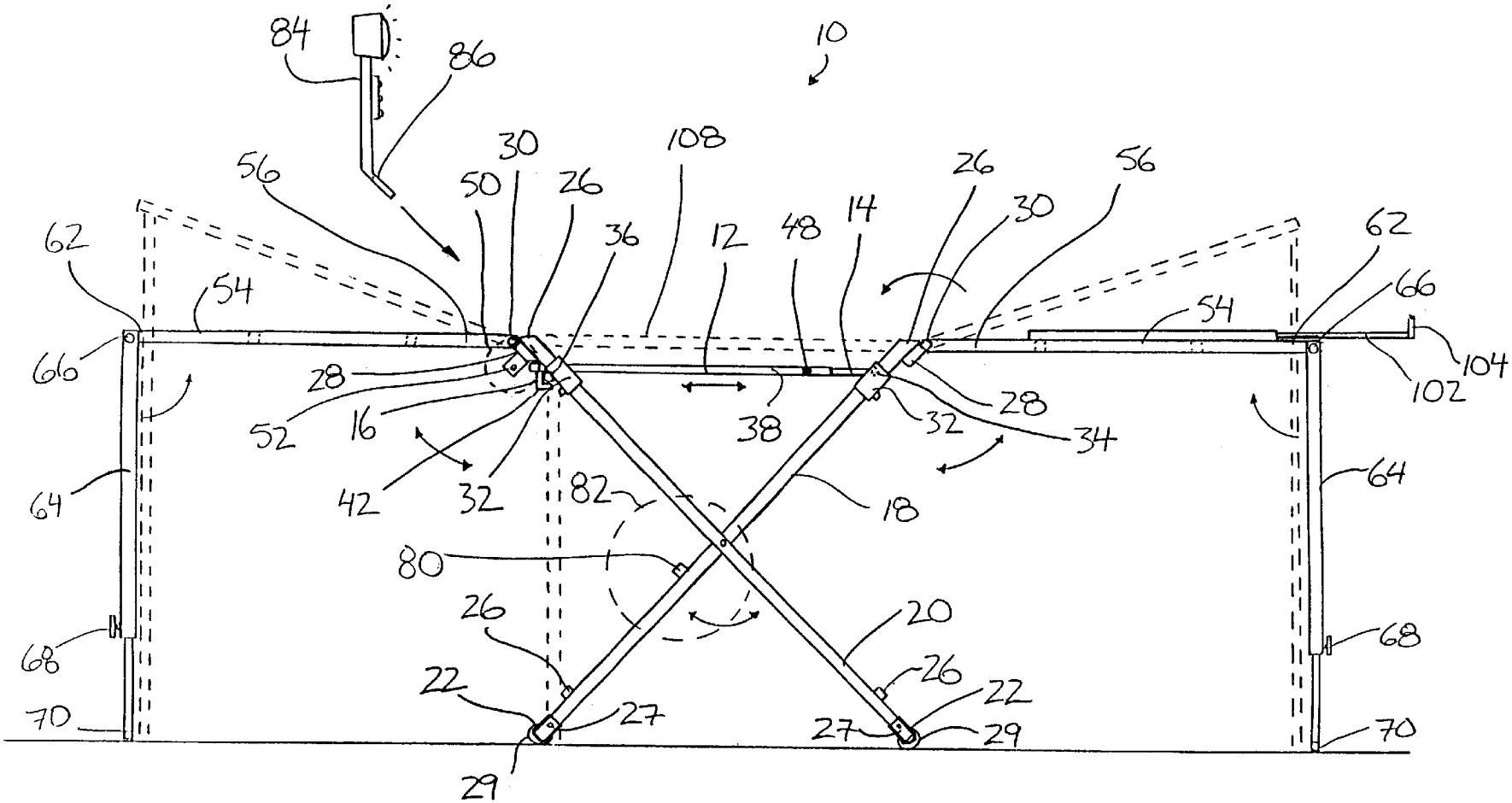
FIG. 1 is a side elevational view of the tool supporting device in a supporting position.
Figure 2:
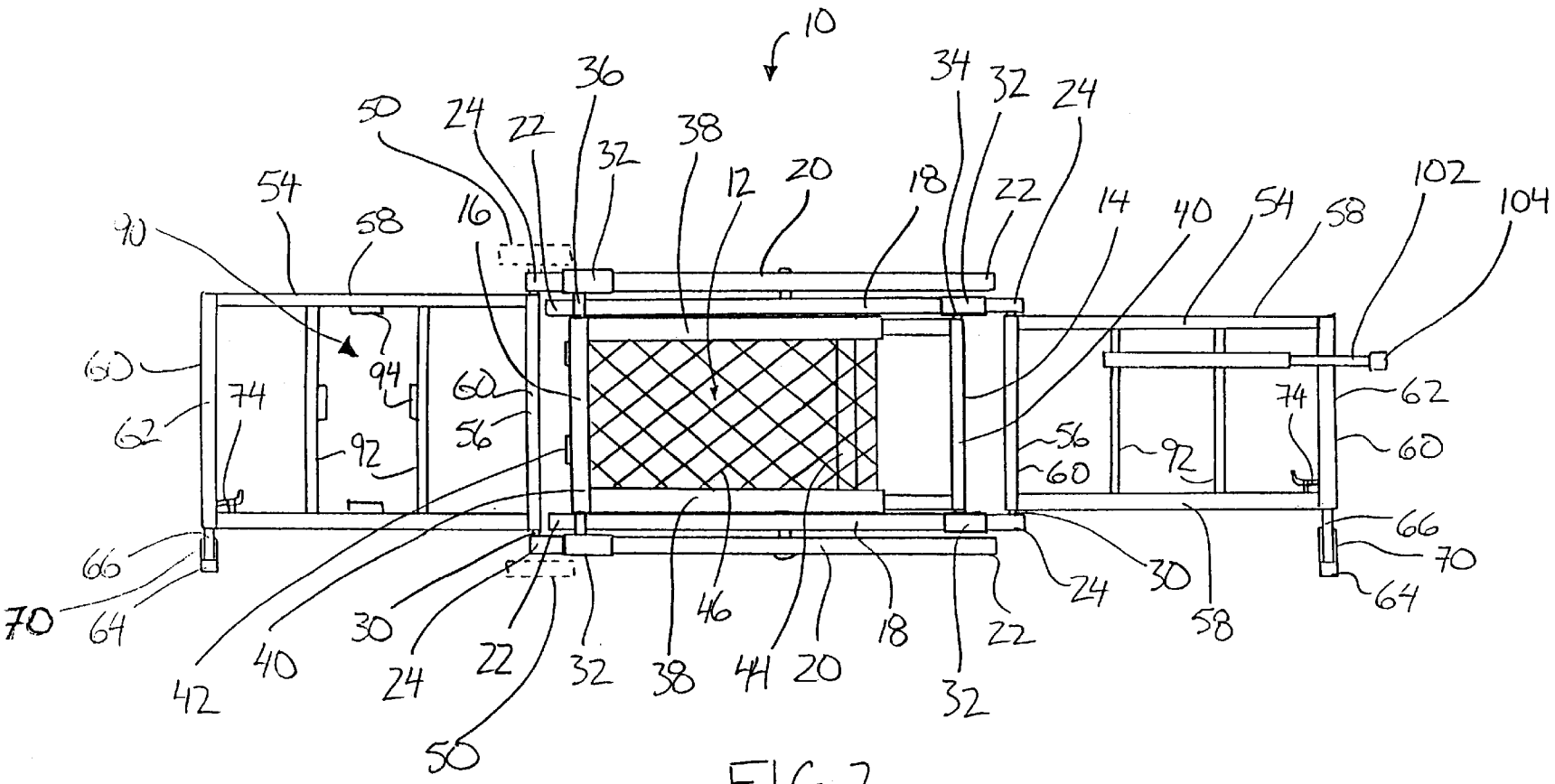
FIG. 2 is a top plan view of the device of FIG. 1.

Referring to the accompanying drawings there is illustrated a tool support generally indicated by reference numeral 10. The tool support is a portable work station for supporting tools and working material thereon.

The tool support 10 includes a main table 12 which is elongate and rectangular, extending longitudinally from a pivot end 14 to a releasable end 16. The main table 12 is supported on a collapsible frame structure.

The frame structure comprises a pair of inner legs 18 and a pair of outer legs 20. Each pair of legs is mounted parallel and spaced apart such that each leg extends longitudinally from a ground engaging end 22 to a supporting end 24. The pairs of legs are pivotally coupled together at a location spaced centrally between respective ends of both pairs. The pair of inner legs 18 are laterally offset and spaced inwardly from the outer legs 20 such that the legs may be pivoted from a collapsed position wherein both pairs of legs are located within a substantially common plane to a supporting position wherein the pairs of legs extend transversely to each other. The resulting pivoting action of the pairs of legs is scissor-like.

Each pair of legs is mounted together by a cross bar 26 extending between the ground engaging end 22 of the respective legs. A mounting block 28 is welded on an outer side of the supporting end 24 of each leg such that the pairs of legs can be mounted together at a top end by a respective axle extending between the mounting blocks 28 of the respective legs.

The ground engaging end 22 of each leg includes a telescoping collar 27 mounted thereon for adjusting the length of the leg. The main table may thus be levelled on various ground surfaces. A curved end portion 29 is formed in the end of each collar 27 for sliding movement along the ground as the legs are displaced between the collapsed and supporting positions respectively. The curved end portion thus protects the floor supporting the tool supporting device thereon from being marred by the ground engaging ends of the legs as they are displaced along the ground during set up.

The main table 12 is coupled to the legs by a set of collars 32 wherein one collar is mounted for longitudinal sliding movement on each leg. A set screw secures each collar in a desired fixed position on the corresponding leg. A pivot shaft 34 mounts between the collars of the pair of inner legs 18 while a connecting rod 36 mounts between the collars of the pair of outer legs 20. The pivot shaft 34 and the mounting rod 36 support the pivot end and the releasable end of the main table respectively thereon.

The main table 12 includes a pair of telescoping side rails 38 which are mounted parallel and spaced apart by a pair of tubular end members 40 secured between respective ends thereof. The tubular end member 40 at the pivot end 14 of the main table is arranged to receive the pivot shaft 34 therethrough such that the table is rotatable about the pivot shaft 34.

The releasable end 16 of the main table includes a pair of hooks 42 mounted on a bottom side thereof for extending over and around the mounting rod 36 in a supporting position as shown in FIG. 1. A support member 44 is mounted between the telescoping side rails 38 spaced from the releasable end 16 of the main table such that a mesh surface 46 is supported across the top side of the table.

Each side rail 38 of the main table includes a first portion slidably received within a second portion wherein both portions include a plurality of co-operating apertures. A locking member 39 is biased towards the apertures and mounted on an inner side of each side rail 38 such that a length of the main table is selectively adjustable by securing the locking member through any desired pair of co-operating apertures within each side rail.

Figure 8:
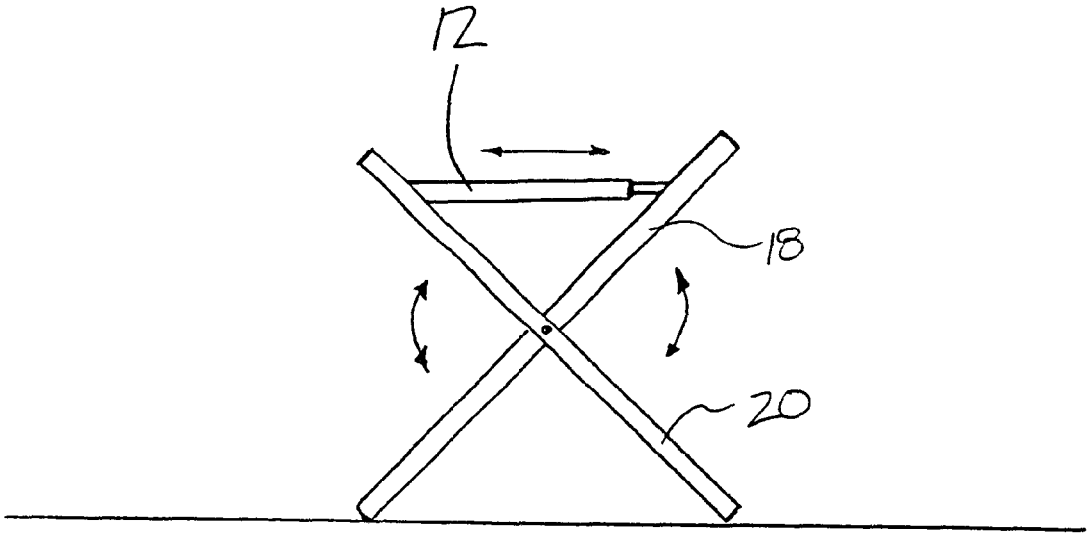
FIGS. 8A and 8B are side elevational views of the tool supporting device showing the relationship between the length of the main table and the resultant height of the legs supporting the main table thereon.
Figure 8:
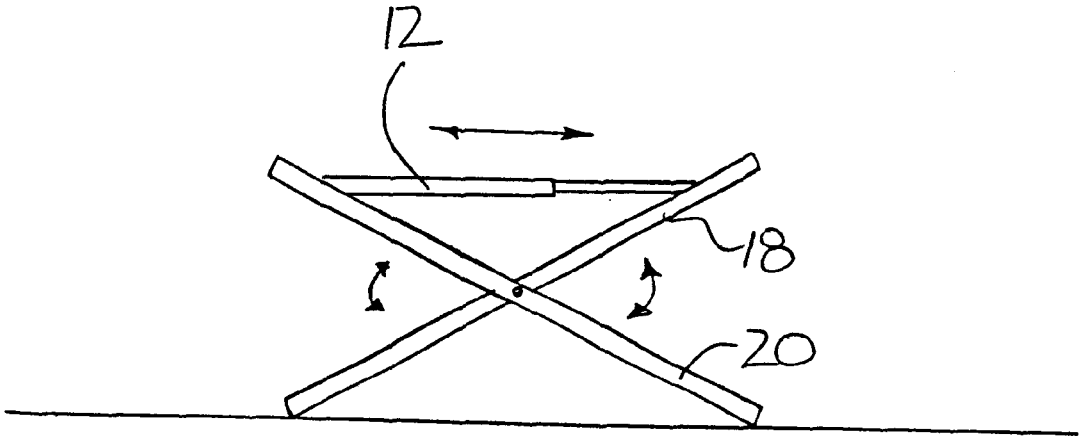

The scissor like arrangement of the inner and outer legs permits an overall height of the legs to be adjusted as the length of the table is adjusted as illustrated in FIG. 8. The length of the table thus determines the relative orientation of the pair of legs 18 and 20. A stop 48 is mounted on the outer side of each rail for restricting the length of the table to a maximum allowable length so that the table is not permitted to fall in the event that the locking members of the side rails are released.

A pair of wheels 50 are mounted adjacent the pair of outer legs 20. A wheel mount 52 extends outwardly from each leg of the pair of outer legs in a direction perpendicular to the leg for mounting one of the wheels 50 thereon. Each wheel mount is arranged to mount the corresponding wheel thereon such that the wheel is spaced outwardly from the main table 12 so as not to interfere with a upper working surface thereof. A pair of auxiliary tables 54 are provided wherein each table is mounted at an inner end 56 on the supporting ends 24 of the respective pairs of legs. Each auxiliary table 54 includes a frame having a pair of side rails 58 connected at respective ends by a pair of end tubes 60. The end tube 60 at the inner end 56 of each auxiliary table receives a corresponding one of the axles 30 therethrough such that the axle acts as a pivot shaft for rotatably mounting the auxiliary table 54 thereon.

A free end 62 of each auxiliary table is supported by an auxiliary leg 64 mounted thereon such that the auxiliary tables extend substantially parallel to the main table in a supporting position as shown in FIG. 1. Each auxiliary leg 64 includes a pivot shaft 66 mounted perpendicularly to the leg at a top end thereof such that the pivot shaft is received within the corresponding end tube 60 at a free end of the table for pivotal movement therein. The leg is thus mounted on a side of the auxiliary table for rotatable movement about the pivot shaft such that the auxiliary leg may be positioned to extend alongside the corresponding auxiliary table 54 within a substantially common plane therewith.

Each auxiliary leg 64 comprises a first and second telescoping members slidably received one inside the other for adjusting an overall height of the leg. A set screw 68 restricts relative sliding movement therebetween as desired for selecting a desired height of the leg such that the auxiliary tables can be supported at any number of relative heights in angles to the main table 12. Each auxiliary leg 64 further includes a foot member 70 in the form of a rigid member extending perpendicularly at a free end of the leg.

Each end tube 60 located at the free end 62 of each auxiliary table 54 includes a plurality of apertures therein for co-operation with a plurality of apertures in the pivot shaft 66 received therein. A locking member 72 is arranged to be inserted through a co-operating pair of the apertures to selectively restrict movement of the auxiliary leg 64 relative to the corresponding auxiliary table 54 as desired. The locking member includes a spring mechanism 74 for biasing the locking member into the apertures.

The legs and tables of the tool support 10 are generally formed of tubular steel having a rectangular cross section. The axles 30 as well as the pivot shafts are formed of a round rod or tube which is fitted within the corresponding tubular member of rectangular cross section for rotatable movement therein. The components of the tool support are thus freely rotatable relative to one another without binding.

Figure 4:
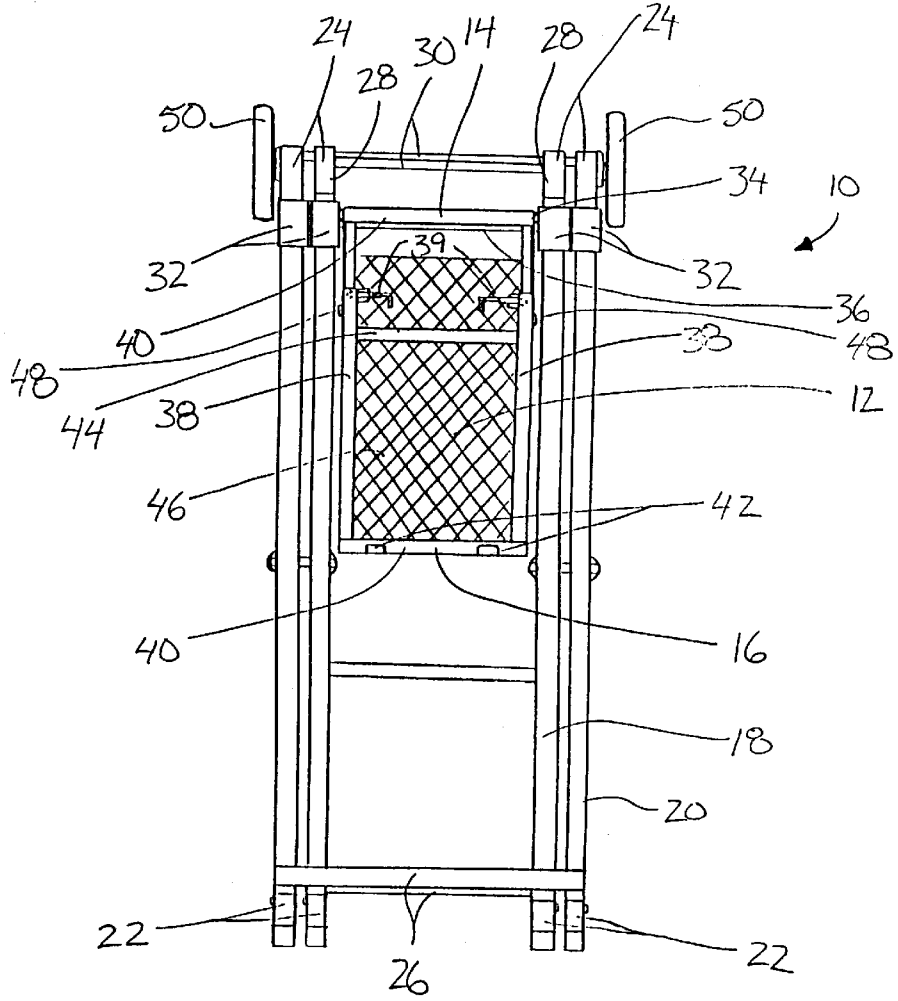
FIG. 4 is an elevational view of the device along the line 4—4 of FIG. 3 shown in the collapsed position with the auxiliary supporting surfaces removed therefrom.
Figure 3:
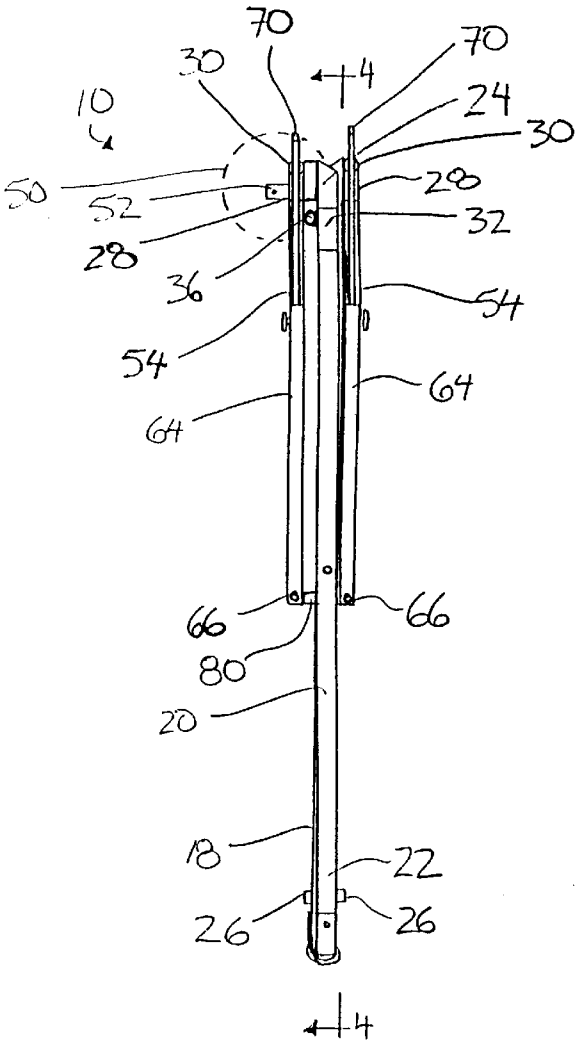
FIG. 3 is a side elevational view of the tool supporting device according to FIG. 1 shown in a collapsed position.
Figure 6:
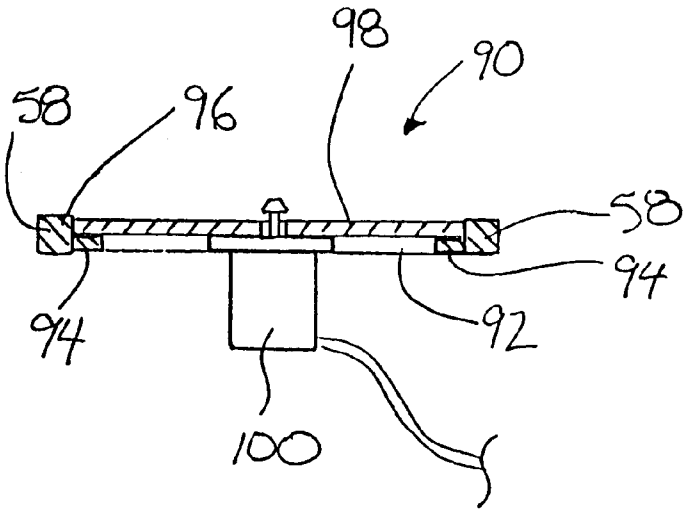
FIG. 6 is a cross sectional view along the line 6—6 of FIG. 5 showing a router table accessory mounted thereon.
Figure 5:
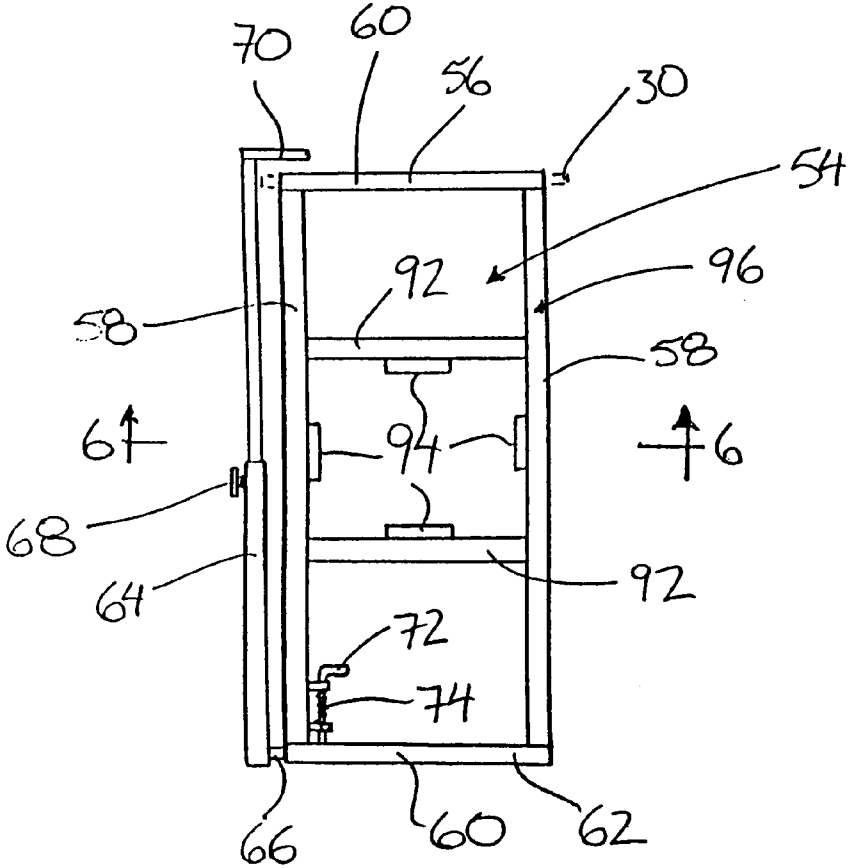
FIG. 5 an elevational view generally along the line 4—4 of FIG. 3 of one of the auxiliary supporting surfaces.

The main table 12 is spaced inwardly and located between each pair of legs 18 and 20 such that upon release of the releasable end of the main table the table end legs may be pivoted into the collapsed position shown in FIGS. 3 and 4 wherein the inner and outer legs and the main table lie in a substantially common plane forming a flat structure which takes up little space in storage. Accordingly the auxiliary leg 64 of each auxiliary table 54 is arranged to extend alongside the table in a substantially common plane therewith to form a flat structure adjacent the flat structure formed by the main table 12.

The mounting blocks 28 mount the axles 30 thereon such that the axles are offset and spaced outwardly from the main table for mounting the corresponding auxiliary tables thereon adjacent and parallel to the main table in the collapsed positions shown in FIGS. 3 and 4. The auxiliary tables lie flat against respective top and bottom faces of the main table in the collapsed position to form a substantially flat structure for occupying minimal space in storage.

A reel mount 80 in the form of a cross bar extends between the outer legs 20 spaced upwardly from the ground engaging end thereof. The reel mount 80 extends perpendicularly to the legs such that a reel 82 may be rotatably mounted thereon. The tool support 10 may thus be used to dispense wire from a reel.

An electrical accessory 84 may be mounted on the supporting end of one of the legs for providing a light source and a power supply to the tool support. The accessory 84 includes a bent tube 86 which is telescopically received within an end of the leg. The bent tube mounts a light source and a four way adapter thereon.

A router table 90 is provided and adapted to mount on one of the auxiliary tables 54. Each auxiliary table 54 includes a pair of cross members 92 which are mounted between side rails 58 thereof thus defining a rectangular opening therebetween. A plurality of flanges 94 are mounted on the inner sides of the side rails 58 and the cross members 92 wherein the flanges 94 are recessed from a top surface 96 of the auxiliary table. The flanges 94 thus define a shoulder of the rectangular opening for supporting a rectangular plate member 98 thereon. The plate 98 is arranged to be mounted flush with the top surface 96 of the auxiliary table when supported on the flanges 94. An opening in the plate 98 is arranged to receive the bit of a router 100 therethrough wherein the router is mounted on a bottom side of the plate.

An extension rail 102 in the form of a telescoping rod is mounted on a top side of one of the auxiliary tables 54 to slidably extend longitudinally outwardly from the table. A stop 104 is mounted on an end of the extension rail 102 for engaging work materials supported thereon to prevent the materials from sliding off an end of the auxiliary table 54.

Figure 7:
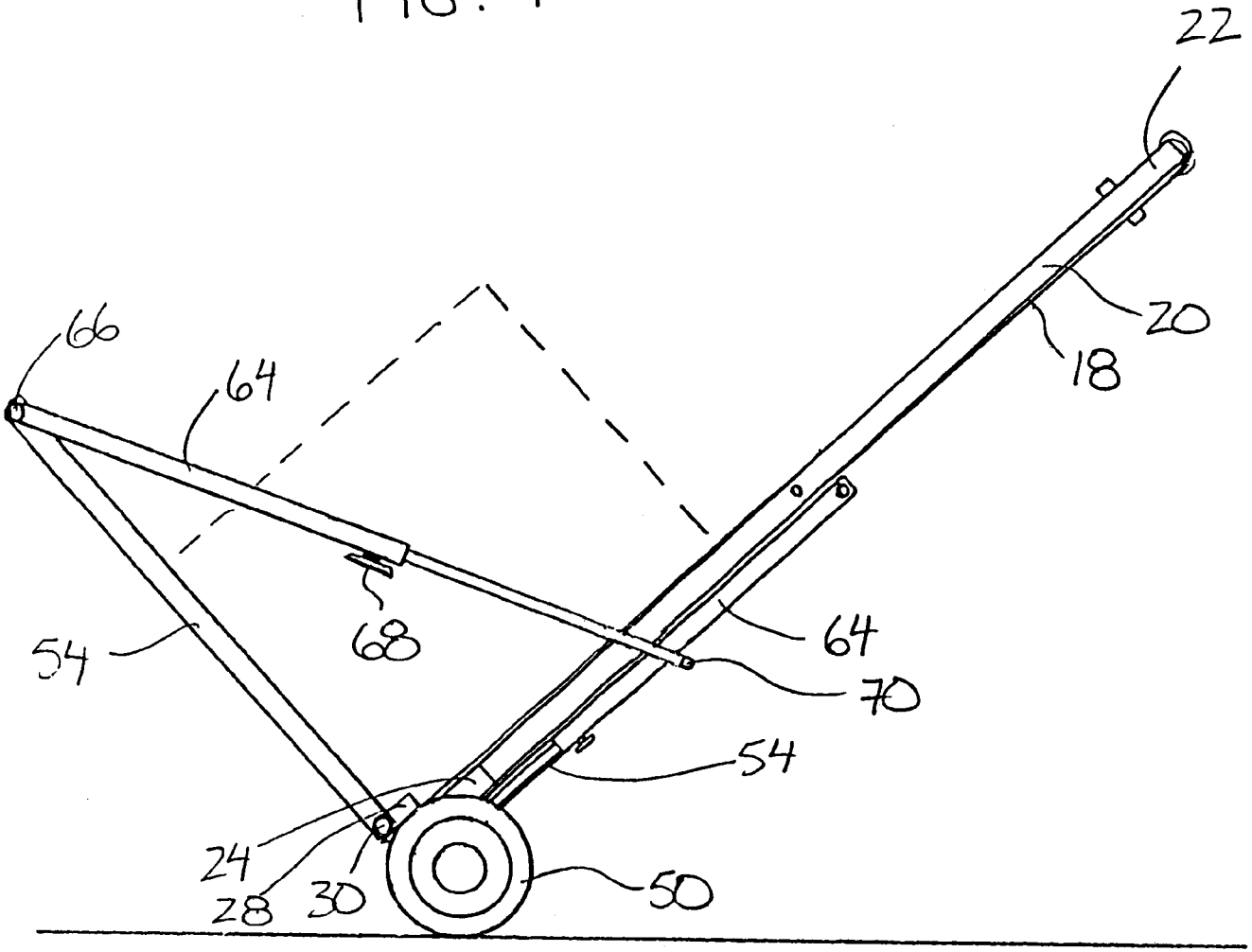
FIG. 7 is a side elevational view of the tool supporting device in a transport position for supporting materials thereon for rolling movement along the ground.

In a transport position as shown in FIG. 7 the auxiliary table 54 which is coupled to the inner pair of legs 18 may be pivoted outwardly from the collapsed position of FIG. 3 to extend perpendicularly to the main table 12. The auxiliary leg 64 which is mounted on the free end of the auxiliary table 54 can be pivoted to extend between the free end of the auxiliary table and the main table at a position spaced towards the releasable end thereof. The foot member 70 acts as a coupling for engaging the back side of the main table such that the auxiliary leg 64 secures the auxiliary table and the main table in a fixed relationship therebetween such that the tables form a cradle which is supported for rolling movement on the ground. The tool support 10 may thus be used as a trolley in the transport position to support work materials and tools thereon.

As shown in FIG. 1, the main table is mounted at a location on the inner and outer legs 18 and 20 spaced inwardly from the supporting ends 24 thereof such that the main table is parallel and spaced below the auxiliary tables 54. One of the auxiliary tables 54 may be pivoted into a secondary position above the main table indicated by reference numeral 108. In this position the pair of auxiliary tables 54 form a continuous supporting surface while the corresponding auxiliary leg 64 continues to support the free end of the table. The length of the auxiliary tables is less than the length of the inner and outer legs but greater than an overall length of the main table 12. The auxiliary tables 54 are thus dimensioned to act as a secondary support when oriented to extend substantially vertically along side the inner and outer legs in the supporting position. The auxiliary tables may be used to support the legs in this position until the user of the tool support 10 has had an opportunity to secure the releasable end of the main table on the mounting rod 36.

Additional tables may be employed by using a coupling which is adapted to secure the additional tables on the respective free ends of the auxiliary tables 54. The additional tables would require the use of additional supporting legs similarly arranged to the auxiliary legs 64 so as to be folded flat with the respective tables in the collapsed position.

While one embodiment of the present invention has been described in the foregoing, it is to be understood that other embodiments are possible within the scope of the invention. The invention is to be considered limited solely by the scope of the appended claims.

What is claimed is:

1. A tool supporting device comprising:

a first pair of elongate legs mounted parallel and spaced apart from each other, each leg having a ground engaging end and a supporting end;

a second pair of elongate legs mounted parallel and spaced apart from each other, each leg having a ground engaging end and a supporting end, the second pair of legs being pivotally coupled to the first pair of legs between the respective ends of the legs of both the first and second pairs wherein the second pair of legs is laterally offset from the first pair of legs such that the legs are pivotal between a collapsed position wherein the legs are substantially parallel and adjacent to each other and a supporting position wherein the supporting and ground engaging ends of the respective first and second pairs of legs are spaced apart from each other; and a main supporting surface extending longitudinally between respective first and seconds ends thereof, the supporting surface being pivotally mounted at the first end on the first pair of legs adjacent the supporting end thereof and being selectively coupled at the second end on the second pair of legs adjacent the supporting end thereof in the supporting position, the supporting surface being located between the legs of each of the first and second pairs of legs such that when the second end of the supporting surface is released from the second pair of legs, the supporting surface is pivotal into the collapsed position wherein the legs extend longitudinally along respective sides of the supporting surface within a substantially common plane therewith.

2. The tool supporting device according to claim 1 wherein the first pair of elongate legs are spaced inwardly from the second pair of elongate legs such that the supporting surface is received therebetween in the collapsed position.

3. The tool supporting device according to claim 1 wherein there is provided a pair of wheels mounted adjacent the supporting end of one of the pairs of legs for engaging the ground in the collapsed position.

4. The tool supporting device according to claim 3 wherein there is provided a wheel mount mounting the wheels thereon wherein the wheel mount is mounted on one of the pairs of legs and extends outwardly therefrom at a position spaced inwardly from the supporting end of the legs such that the wheels do not extend past the supporting surface in the supporting position.

5. The tool supporting device according to claim 1 wherein there is provided an adjustable mount on the supporting surface such that the supporting surface is adjustable in length whereby adjustment of a length of the supporting surface will correspondingly adjust a height of the legs supporting the supporting surface thereon.

6. The tool supporting device according to claim 5 wherein the supporting surface comprises a first portion telescopically received within a second portion thereof and the adjustable mount comprises a locking member which is received through co-operating apertures in the first and second portions such that the locking member restricts relative movement therebetween.

7. The tool supporting device according to claim 1 wherein there is provided a pivot shaft mounted on the supporting end of the first pair of legs to extend therebetween and wherein the first end of the supporting surface comprises a tubular member arranged to receive the pivot shaft therethrough such that the supporting surface is rotatable about the pivot shaft.

8. The tool supporting device according to claim 1 wherein there is provided a cross member mounted between the legs of the second pair of legs adjacent the supporting end thereof and wherein there is provided at least one hook member mounted on the second end of the supporting surface arranged to receive the cross member therein in the supporting position for selectively coupling the supporting surface to the second pair of legs.

9. The tool supporting device according to claim 1 wherein the supporting surface is supported at respective ends on the first and second pairs of legs respectively by a collar slidably mounted on each leg and wherein there is provided a locking member for securing each collar in place such that a height of the frame is adjustable.

10. The tool supporting device according to claim 1 wherein there is provided a cross member mounted between the legs of one of the pairs, the cross member being mounted perpendicularly to the legs for supporting a reel thereon such that the reel is rotatably mounted thereon between the legs.

11. The tool supporting device according to claim 1 wherein there is provided a curved portion at a ground engaging end of each leg for sliding movement along the ground as the legs are displaced between the collapsed and supporting positions.

12. A tool supporting device comprising:

a first pair of elongate legs mounted parallel and spaced apart from each other, each leg having a ground engaging end and a supporting end;

a second pair of elongate legs mounted parallel and spaced apart from each other, each leg having a ground engaging end and a supporting end, the second pair of legs being pivotally coupled to the first pair of legs between the respective ends of the legs of both the first and second pairs wherein the second pair of legs is laterally offset from the first pair of legs such that the legs are pivotal between a collapsed position wherein the legs are substantially parallel and adjacent to each other and a supporting position wherein the supporting and ground engaging ends of the respective first and second pairs of legs are spaced apart from each other;

a main supporting surface extending longitudinally between respective first and seconds ends thereof, the supporting surface being pivotally mounted at the first end on the first pair of legs adjacent the supporting end thereof and being selectively coupled at the second end on the second pair of legs adjacent the supporting end thereof in the supporting position, the supporting surface being located between the legs of each of the first and second pairs of legs such that when the second end of the supporting surface is released from the second pair of legs, the supporting surface is pivotal into the collapsed position wherein the legs extend longitudinally along respective sides of the supporting surface within a substantially common plane therewith;

an auxiliary supporting surface pivotally mounted at an inner end thereof adjacent the supporting end of one of the pairs of legs and extending outwardly to a free end thereof, the inner end of the auxiliary supporting surface being offset from the supporting end of the pairs of legs such that the auxiliary support surface is pivotal to extend parallel and adjacent to the main supporting surface in the collapsed position; and an auxiliary leg pivotally mounted on the free end of the auxiliary supporting surface being arranged to support the auxiliary supporting surface to extend substantially parallel to the main supporting surface in the supporting position, the auxiliary leg being coupled to a side of the auxiliary supporting surface such that in the collapsed position the leg is pivotal to extend longitudinally alongside the auxiliary supporting structure within a substantially common plane therewith.

13. The tool supporting device according to claim 12 wherein the auxiliary leg is adjustable in length such that the auxiliary supporting surface can be supported at various angles relative to the main supporting surface in the supported position.

14. The tool supporting device according to claim 12 wherein there is provided a pivot shaft mounted between legs of one of the pairs adjacent the supporting end thereof and wherein an end of the auxiliary supporting surface comprises a tubular member mounting the pivot shaft therethrough such that the auxiliary supporting surface is rotatable about the pivot shaft.

15. The tool supporting device according to claim 12 wherein there is provided a pivot shaft mounted on an end of the auxiliary leg and wherein an end of the auxiliary supporting surface comprises a tubular member mounting the pivot shaft therethrough such that the auxiliary leg is rotatable relative to the auxiliary supporting surface.

16. The tool supporting device according to claim 12 wherein the auxiliary leg has a foot mounted on an end thereof, the foot comprises a rigid member which extends at right angles to the leg.

17. The tool supporting device according to claim 12 wherein there is provided a pair of wheels mounted on the supporting end of one of the pairs of legs and wherein there is provided a coupling on a free end of the auxiliary leg being arranged to secure the auxiliary supporting surface to extend transversely to the main supporting surface in a transport position, the supporting surfaces defining cradle therebetween supported for rolling movement on the ground in the transport position.

18. The tool supporting device according to claim 12 wherein there is provided a pair of auxiliary supporting surfaces mounted on the first and second pairs of legs respectively, each auxiliary supporting surface having an auxiliary leg mounted on a free end thereof.

19. The tool supporting device according to claim 12 wherein the main supporting surface is coupled to the respective first and second pairs of legs at a location spaced inwardly from the supporting ends thereof such that the main supporting surface is spaced below the auxiliary supporting surface in the supporting position.

20. The tool supporting device according to claim 12 wherein the auxiliary supporting surface comprises a pair of side rails mounted parallel and spaced apart by a pair of parallel and spaced apart cross members defining a rectangular opening therebetween and wherein there is provided a plurality of flange members mounted in the opening of the auxiliary supporting surface defining a shoulder of the opening for supporting a rectangular plate member therein.

* * * * *